US005160656A

United States Patent [19]

Carron et al.

[11] Patent Number: 5,160,656

[45] Date of Patent: Nov. 3, 1992

[54] AQUEOUS LIQUID BLEACHING DETERGENTS WHICH ARE STABLE DURING STORAGE AND WASHING PROCESS

[75] Inventors: Henry Carron, Pantin; Eric Jourdan-LaForte, Paris, both of France

[73] Assignee: L'Air Liquide, Societe Anonyme pour l'Etude et l'Exploitation des Procedes Georges Claude, Paris, France

[21] Appl. No.: 614,050

[22] Filed: Nov. 13, 1990

Related U.S. Application Data

[63] Continuation of Ser. No. 340,631, Apr. 20, 1989, abandoned.

[30] Foreign Application Priority Data

Apr. 22, 1988 [FR] France ..... 88 05335

[51] Int. Cl.[5] ..... C11D 3/42; C11D 3/06; C11D 3/43

[52] U.S. Cl. ..... 252/99; 252/174.15; 252/174.25; 252/174.23; 252/173; 252/DIG. 2; 252/135; 252/DIG. 14; 252/174.16

[58] Field of Search ..... 252/174.15, 174.25, 252/174.23, DIG. 2, 173, 99, 135, DIG. 14, 174.16, 186.3, 186.31, 186.43

[56] References Cited

U.S. PATENT DOCUMENTS

| | | | |
|---|---|---|---|
| 975,353 | 11/1910 | Grüter et al. | 252/186.11 |
| 975,354 | 11/1910 | Grüter et al. | 252/186.11 |
| 2,094,671 | 10/1937 | Poetschke | 252/186.11 |
| 2,141,189 | 12/1938 | Lind | 252/99 |
| 3,402,038 | 9/1968 | Puchta et al. | 252/99 |
| 3,882,038 | 5/1975 | Clayton et al. | 252/164 |
| 4,482,470 | 11/1984 | Reuter et al. | 252/162 |
| 4,521,326 | 6/1985 | Seibert et al. | 252/174.21 |
| 4,786,431 | 11/1988 | Broze et al. | 252/99 |

FOREIGN PATENT DOCUMENTS

| | | |
|---|---|---|
| 0210114 | 1/1987 | European Pat. Off. . |
| 1320243 | 1/1963 | France . |
| 1420462 | 10/1964 | France . |
| 2140822 | 1/1973 | France . |
| 0551831 | 3/1943 | United Kingdom . |
| 0943271 | 12/1963 | United Kingdom . |

*Primary Examiner*—Paul Lieberman
*Assistant Examiner*—Kery A. Fries
*Attorney, Agent, or Firm*—Browdy and Neimark

[57] ABSTRACT

Alkaline aqueous liquid bleaching detergents that remain stable during storage contain monohydrated sodium perborate, a Mg 3.5 $SiO_2$ magnesium silicate, sodium acid pyrophosphate and a viscosity regulator composed of dialkylether polyethyleneglycol copolymers.

The detergents can be used for washing and bleaching at temperatures between 40° and 90° C.

4 Claims, No Drawings

AQUEOUS LIQUID BLEACHING DETERGENTS WHICH ARE STABLE DURING STORAGE AND WASHING PROCESS

This application is a continuation of application Ser. No. 07/340,631, filed Apr. 20, 1989, now abandoned.

FIELD OF THE INVENTION

This invention pertains to liquid detergents, especially to liquid detergents having bleaching action, that are stable during storage.

BACKGROUND OF THE INVENTION

Liquid household detergents are used increasingly in place of powdered household detergents to wash laundry, either by hand or in washing machines.

This new approach of liquid washing products has given rise to a considerable amount of research to produce formulas attempting to rival the effectiveness of powdered products.

Thus, beginning in 1971, especially in Patent FR 2,140,822, the applicant described liquid bleaching detergents composed of a detergent base and containing a peroxidated compound such as tetrahydrated sodium perborate or hydrogen peroxide and a stabilizing agent, having a pH of 8 to 10.

The object of Patent Application FR 2,522,124 is fluid fabric detergent formulas with bleaching action, that are stable during storage and that contain, in the anhydrous state, hydrogen peroxide and the ingredients detergent baths traditionally comprise, other than persalts and peroxyhydrates. The technique of using hydrogen peroxide in an anhydrous medium does not seem to have emerged as yet on the industrial level. The only formulas currently on the market are made in aqueous media and contain no bleaching agents.

Other research, conducted especially by Unilever NV, according to Patent Application EP 0,217,454, has led to the proposal of non-aqueous liquid detergent formulas containing anhydrous perborate and a bleach activator. Anhydrous perborate is made using a relatively lengthy dehydration technique involving very exacting temperature monitoring, and consequently, the whitening agent has a high cost.

Other patents, especially Patent Application FR 2,562,557 by the Colgate Palmolive Company, disclose compounds containing all of the ingredients normally found in powdered detergents, these liquid formulas being non-aqueous, with the powdered products added to the formulas being in an ultra-fine form obtained by thorough grinding. These formulas, which have a high cost, have not yet appeared on the market.

SUMMARY OF THE INVENTION

Aqueous liquid alkaline detergent formulas containing a bleaching agent have been researched. These perborated detergents are distinguished in that the specially-selected bleaching agent, a source of active oxygen, contains additive stabilizing agents that make the bleaching agent very stable, despite the alkalinity of the medium in aqueous phase; the formula also contains an agent that preserves the homogeneity of the detergent mixture.

Among the peroxides and perhydrates used as sources of active oxygen, monohydrated sodium perborate is the preferred bleaching agent. Tetrahydrated perborate is difficult to use because it requires that the detergent mixture be made more viscous in order to prevent settling and phase separation. In this case, the detergent mixture is too viscous to flow easily out of its container. Sodium percarbonate, a commonly-produced perhydrate, is not appropriate for the field of this invention because of its instability in aqueous media. Its stability can be improved appreciably using certain stabilizing agents, but the results are insufficient to be used industrially for aqueous liquid alkaline detergents.

For the bleach compound, it was found with surprise that only monohydrated perborate was suitable for producing a detergent with a stable active oxygen content that maintained its homogeneous aspect indefinitely despite the high water content.

Formulas have been made with different monohydrated perborate granulometries, ranging from the commonly used quality, in which the granulometric distribution is between 800 and 100 microns, to ground products in which 75% of the monohydrated perborate granules are smaller than 50 microns.

It was observed that the finest granulometries yielded products with the smoothest aspect.

With tetrahydrated sodium perborate, we found that it was impossible to produce a formula that retained its homogeneous aspect, with an identical overall water balance. In this way, it was discovered with surprise that only monohydrated sodium perborate could be used to produce a liquid detergent that retained its homogeneous aspect.

The percentages by weight of monohydrated sodium perborate in the liquid detergents according to the invention can be as high as 20%, are generally between 4 and 15%, and are preferably between 6 and 12%.

The stabilizing effect is produced by adding a Mg 3.5 $SiO_2$ synthetic magnesium silicate to the detergent mixture. This magnesium silicate is prepared by incorporating stable organic complexing agents during the production process. This magnesium silicate thus synthesized is a definite product wherein the interchangeable magnesium in the magnesium silicate is in the form of a magnesium salt of the complexing agent or agents. This preparation method makes the Mg 3.5 $SiO_2$ magnesium silicate highly resistent to use, and gives it excellent peroxide or perhydrate stabilization properties, this product being marketed under the brand name Sydex®.

This stabilizing agent is used in especially advantageous concentrations in proportions of 0.1 to 2.5%. The percentage weights are calculated with respect to the detergent formula.

In addition to the action of the magnesium silicate, the stabilizing effect is reinforced by adding sodium acid pyrophosphate to the detergent formula, this additive acting as a pH buffer, in addition to its stabilizing properties. Sodium acid pyrophosphate is preferably used in proportions by weight of 0.5 to 10% of the detergent formula.

The presence of a viscosity regulator is an integral part of the new detergent formulas, in order to maintain the initial homogeneous aspect for several months, and in order to prevent any sedimentation or formation of separate phases.

Dialkylether polyethyleneglycol copolymers, in which the alkyl remainder can be a linear or branched chain of 8 to 18 carbon atoms, are especially suitable as the viscosity regulating copolymers. The copolymer is used in proportions of 0.5 to 7.5% and preferably 2 to 5% by weight with respect to the detergent formula.

It was found that the stabilizing formula composed of the Mg 3.5 $SiO_2$ magnesium silicate + sodium acid pyrophosphate couple acts along with the viscosity regulator, dialkylether polyethyleneglycol, in order make the detergent permanently homogeneous.

Test formulas made as controls containing no viscosity regulator do not retain their homogeneous aspect. Likewise, formulas containing only the viscosity regulator, without magnesium Mg 3.5 $SiO_2$ silicate or sodium acid pyrophosphate, lose their homogeneous aspect after a few days, with a transparent liquid phase forming over a thick, opaque phase.

In addition to the ingredients according to the invention, the aqueous detergent formula contains the customary ingredients:

Non-ionic and anionic detergents neutralized with triethanolamine or soda, for example, in order to produce an appropriate pH of approximately 7 to 10;

Cleaning power additives, primarily to sequester calcium and magnesium ions, which we consider as anti-incrustation agents such as phosphates, acrylic derivatives, citrates, etc.

Fluidizing agents to regulate the viscosity of the detergent, such as isopropyl alcohol, for example, to fluidize the non-ionic surface-active agents;

Anti-redeposition agents to hold dirt in suspension in the washing bath, such as carboxymethyl cellulose or polyvinylpyrrolidone, for example;

Optical brighteners having affinity for textile fibers, to increase the visual sense of whiteness;

Enzymes such as amylase, protease and lipase types, combined with enzyme stabilizing agents, to break down protein and starch stains;

Fragrances and coloring agents, if applicable. All of these ingredients are well known to those skilled in the industry.

The liquid whitening detergents according to the invention make it possible to obtain highly satisfactory washing and whitening results at conventional treatment temperatures, preferable between 40° and 90° C. Washing cycles are conventional in length, preferably between 10 and 60 minutes.

Below are example embodiments providing a non-restrictive illustration of the invention.

EXAMPLE No. 1

Formula No. 1

| | |
|---|---|
| Ethoxylated fatty alcohol - lauryl type condensed with 9 ethylene oxide molecules | 5% |
| Sodium sulfonate dodecylbenzene | 10.5% |
| Carboxymethylcellulose | 1% |
| Caustic soda | 1.2% |
| Sodium acid pyrophosphate | 4% |
| Sydex ® | 1% |
| Optical brightener (Ciba-Geigy Tinopal CBS - X ®) | 0.2% |
| Dialkylether polyethyleneglycol | 3.75% |
| Monohydrated sodium perborate (ground fines) | 10% |
| Q.S. of water for 100%, i.e. | 63.35% |

The above formula behaves very well in terms of fluidity and lasting aspect of the mixture, as well as the stability of the monohydrated perborate used.

After 5 months of storage at room temperature, approximately 20°-25° C., the monohydrated perborate content was unchanged, being 9.82% on the day of preparation, and 9.77% after 5 months, i.e., a perborate content decrease of 0.05%. The pH in this case was 9.2, and was 9.77 after 1/5 dilution.

The monohydrated perborate used in this formula was a finely ground quality, with 75% of the product having a granulometry smaller than 50 microns.

A compound similar, to the one in Example 1, without the dialkylether polyethyleneglycol copolymers, rapidly developed a non-homogeneous aspect characterized by the appearance of a transparent liquid phase over a thick, opaque phase.

EXAMPLE No. 2

Formula No. 2

| | |
|---|---|
| Tallow alcohol 16-18 condensed with 11 ethylene oxide molecules | 10% |
| Sodium sulfonate dodecylbenzene | 9% |
| Carboxymethylcellulose | 1% |
| Caustic soda | 1.2% |
| Sodium acid pyrophosphate | 4% |
| Sydex ® | 1% |
| Optical brightener (Ciba-Geigy Tinopal CBS - X ®) | 0.2% |
| Dialkylether polyethyleneglycol copolymer | 2.25% |
| Monohydrated sodium perborate (ground fines) | 10% |
| Q.S. of water for 100%, i.e. | 61.35% |

This non-ionic surface active agent-reinforced formula behaves very well in storage, in terms of aspect as well as active oxygen content. During a 3-month period, the perborate content remained virtually unchanged, moving from 10.1% to 9.85%, i.e., a loss of 0.25%. Those skilled in the industry know that changes of this magnitude pose no problems for powdered products.

EXAMPLE No. 3

Comparative

This formula, which is similar to Formula No. 2, was made using fine quality tetrahydrated sodium perborate in place of fine quality monohydrated sodium perborate.

Formula No. 3.

| | |
|---|---|
| Tallow alcohol 16-18 condensed with 11 ethylene oxide molecules | 10% |
| Sodium sulfonate dodecylbenzene | 9% |
| Carboxymethylcellulose | 1% |
| Caustic soda | 1.2% |
| Sodium acid pyrophosphate | 4% |
| Sydex ® | 1% |
| Optical brightener (Ciba-Geigy Tinopal CBS - X ®) | 0.2% |
| Dialkylether polyethyleneglycol | 2.25% |
| Tetrahydrated sodium perborate (fine quality) | 15% |
| Q.S. of water for 100%, i.e. | 56.35% |

After a few days of storage, this formula, whose active oxygen content was identical to the formula in Example 2, developed a non-homogeneous aspect characterized by a transparent liquid phase over a thick, opaque phase.

EXAMPLE No. 4

Formula No. 4

| | |
|---|---|
| Tallow alcohol 16-18 condensed with 11 ethylene oxide molecules | 10% |
| Sodium sulfonate dodecylbenzene | 9% |

-continued

| | |
|---|---|
| Carboxymethylcellulose | 1% |
| Caustic soda | 1.2% |
| Sodium acid pyrophosphate (Na2H2P2O7) | 4% |
| Sydex ® | 1% |
| Tinopal CBS - X ® (Ciba-Geigy) | 0.2% |
| Dialkylether polyethyleneglycol | 2.25% |
| Monohydrated sodium perborate | 10% |
| Q.S. of water for 100%, i.e. | 61.35% |

In the above formulas, a fine granulometric quality monohydrated perborate was used, 75% of which was smaller than 50 microns.

In formula No. 4, the monohydrated sodium perborate was standard quality, i.e., its granulometry was between 100 and 800 microns, presenting no problems in terms of maintaining the product's homogeneous aspect for several months.

The granulometry of the perborate had no influence on its stability in the area of aqueous liquid alkaline detergents within the context of the invention.

EXAMPLE No. 5

Formula No. 5

| | |
|---|---|
| Ethoxylated fatty alcohol, lauryl type, with 9 ethyleneoxide molecules | 5% |
| Ethoxylated fatty alcohol with 7 ethylene oxide molecules (ICI Synperonic A7) | 5% |
| Sodium sulfonate dodecylbenzene | 9% |
| Carboxymethylcellulose | 1% |
| Caustic soda | 0.9% |
| Sodium acid pyrophosphate | 4% |
| Sydex ® | 1% |
| Didodecyl ether polyethyleneglycol | 3.15% |
| Optical brightener (Ciba-Geigy Tinopal CBS - X ®) | 0.2% |
| Enzyme - Esperase 8.0 L ® | 0.8% |
| Enzyme stabilizer (Calcium salt) | 0.2% |
| Anti-foaming agent (Rhône-Poulenc Rhodorsil 412 ®) | 0.05% |
| Monohydrated sodium perborate | 10% |
| Q.S. of water for 100%, i.e. | 59.7% |

The above formula was made with fine quality monohydrated sodium perborate, with 75% of the granulometry being between 125 and 40 microns.

It also contains enzymes, in this case, liquid Esperase ® 8.0 L by Novo Industri A/S. These enzymes were combined with an enzyme protector such as a calcium salt, for example, calcium chloride or lime.

Like the above formulas, this one has a stable and homogeneous aspect that does not change as a function of storage time.

To demonstrate the efficiency of the formulas according to the invention, washing tests were conducted using Terg-O-tometer ® machines, at 60° C. for 40 minutes, including temperature build-up time. Efficiency was determined based on a comparison with 2 detergents available on the market containing no bleaching agent, by determining the bleaching of the test fabrics. The bleaching effects on oxidizable stains such as wine, tea and coffee is expressed in average % removal evaluated using the following formula:

$$\frac{TL - TS}{TNS - TS} \times 100$$

wherein:

TS = Reflectance, fabric stained with wine, tea or coffee

TNS = Reflectance, white unstained fabric

TL = Reflectance, stained fabric subjected to the washing test.

The reflectance of the fabrics was evaluated using an Elrepho ® light meter, with blue filter for the tristimulus range.

The bleaching effect was also evaluated using bleached fabric placed in the wash in order to determine the degree of redeposition of dirt and the brightening effect.

WF = The degree of redeposition of dirt—This evaluation was conducted using the following formula:

$$WF = 100 - \sqrt{(100 - TM)^2 + (FC)^2}$$

wherein

TM = average tone, i.e., the average of reflectances X, Y and Z (Tristimulus filter amber, green and blue) with UV-free illuminant.

FC2 = Coloration factor. This is the sum of the differences in absolute value between TM and reflectances X, Y and Z.

WB = Brightening effect evaluated according to Madame Berger's formula: RY + 3 (RZ − RX) after determining reflectants RX, RY, RZ under UV illuminant (xenon lamp without filter).

The table below summarizes the results obtained after washing at 60° C.

| Composition According to Invention | pH of Wash | Whitening % Average Stain Removal of Wine/Tea/ Coffee Stains | WF | WB | Cleaning Power of Average % Removal |
|---|---|---|---|---|---|
| Example 2 | 9.5 | 53% | 86 | 142 | 33 |
| Example 4 | 9.4 | 52% | 85 | 142 | 30 |
| Example 5 | 9.4 | 55% | 87 | 149 | 31 |
| Control detergents commercially available without whitening agents. | | | | | |
| Detergent A (containing phosphates) | 8.6 | 39% | 84 | 140 | 30 |
| Detergent B (without phosphates) | 7.4 | 35% | 78 | 113 | 26 |

The results show that the formulas according to the invention are more effective as bleaching agent than liquid detergents A and B which are currently commercially available.

The formula according to Example 1 was not tested because of the absence of optical brightening agent, in order to avoid inequitable comparisons.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

We claim:

1. A homogeneous aqueous liquid bleaching detergent stable in alkaline media comprising at most 20% by weight of monohydrated sodium perborate, a stabilizing agent comprising a mixture of a Mg3.5 $SiO_2$ synthetic magnesium silicate present in amounts of from about 0.1% to about 2.5% by weight and a sodium acid pyrophosphate present in amounts of from about 0.5 to about 10% by weight, and a viscosity regulator comprising dialkylether polyethylene glycol copolymers present in amounts of from about 0.5 to about 7.5% by weight.

2. A homogeneous aqueous liquid bleaching detergent according to claim 1 wherein said monohydrated sodium perborate is present in amounts of from about 4 to about 15% by weight, said Mg3.5 $SiO_2$ synthetic magnesium silicate is present in amount of from about 0.1% to about 2.5% by weight, said sodium acid pyrophosphate is present in amounts of from about 0.5% to about 7.5% by weight, and said dialkylether polyethylene glycol copolymers are present in amounts of from about 0.5% to about 7.5% by weight.

3. A homogeneous aqueous liquid bleaching detergent according to claim 1 wherein said monohydrated sodium perborate is present in amounts of from about 6 to about 12% by weight, said Mg3.5 $SiO_2$ synthetic magnesium silicate is present in amounts of from about 0.1 to about 2.5% by weight; said sodium acid pyrophosphate is present in amounts of from about 0.5% to about 7.5% by weight, and said dialkylether polyethylene glycol copolymers are present in amounts of from about 0.5 to about 7.5% by weight.

4. A process for washing and bleaching laundry comprising adding to wash water a liquid bleaching detergent according to claim 1, wherein the temperature of the wash water is between about 40° and about 60° C.

* * * * *